US005111869A

United States Patent [19]

Corbett et al.

[11] Patent Number: 5,111,869

[45] Date of Patent: May 12, 1992

[54] EVAPORABLE FOAM PATTERN FOR CASTING A CYLINDER BLOCK OF A TWO-CYCLE ENGINE

[75] Inventors: William D. Corbett; Benjamin L. Sheaffer, both of Fond du Lac, Wis.

[73] Assignee: Brunswick Corporation, Skokie, Ill.

[21] Appl. No.: 635,762

[22] Filed: Dec. 28, 1990

[51] Int. Cl.[5] ..... B22C 7/02

[52] U.S. Cl. ..... 164/45; 164/235

[58] Field of Search ..... 164/34, 35, 45, 235, 164/246

[56] References Cited

U.S. PATENT DOCUMENTS

| | | | |
|---|---|---|---|
| 4,243,093 | 1/1981 | Nieman | 164/96 |
| 4,632,169 | 12/1986 | Osborn et al. | 164/45 |
| 4,640,333 | 2/1987 | Martin et al. | 164/246 |
| 4,657,063 | 4/1987 | Morris | 164/45 |
| 4,777,997 | 10/1988 | Corbett | 164/246 |
| 4,802,447 | 1/1989 | Corbett | 123/65 |
| 4,883,110 | 11/1989 | Morgan et al. | 164/249 |
| 4,907,638 | 3/1990 | Hubbell et al. | 164/45 |
| 4,951,733 | 8/1990 | Kusche et al. | 164/246 |
| 4,964,454 | 10/1990 | Hubbell et al. | 164/246 |
| 4,969,504 | 11/1990 | Ruhnke et al. | 164/235 |

FOREIGN PATENT DOCUMENTS

| | | |
|---|---|---|
| 2569225 | 2/1986 | France . |
| 52-29522 | 3/1977 | Japan . |
| 62-148055 | 7/1987 | Japan . |
| 62-282763 | 12/1987 | Japan . |

*Primary Examiner*—Kuang Y. Lin

*Attorney, Agent, or Firm*—Andrus, Sceales, Starke & Sawall

[57] ABSTRACT

An evaporable foam pattern for casting the engine block of a two-cycle engine. The pattern has a crankcase end and a head end and a plurality of cylinders extend from the crankcase end toward the head end. A plurality of transfer passages are disposed longitudinally of each cylinder and one end of each transfer passage communicates with the crankcase end, while the second or discharge end of the transfer passage communicates through a transfer port with the cylinder adjacent the head end of the pattern. The pattern is composed of a crankcase section and a head section which are joined along a parting line disposed normal to the axis of the cylinder, with the parting line intersecting the transfer passages adjacent the discharge end of the passages. A portion of the cylinder in the head section located adjacent the parting line is enlarged in diameter and is connected to the cylinder by a plurality of ledges that are disposed between the transfer passages. The pattern also includes an evaporable foam ring which is disposed within the enlarged cylinder portion of the head section and one end of the ring has a plurality of ears which engage the ledges. Recessed edges of the ring extending between the ears bridge the transfer passages and partially define the transfer ports. An adhesive joins the abutting surfaces of the crankcase and head pattern sections, as well as securing the ring in the enlarged cylinder portion of the head pattern section.

14 Claims, 2 Drawing Sheets

FIG. 2
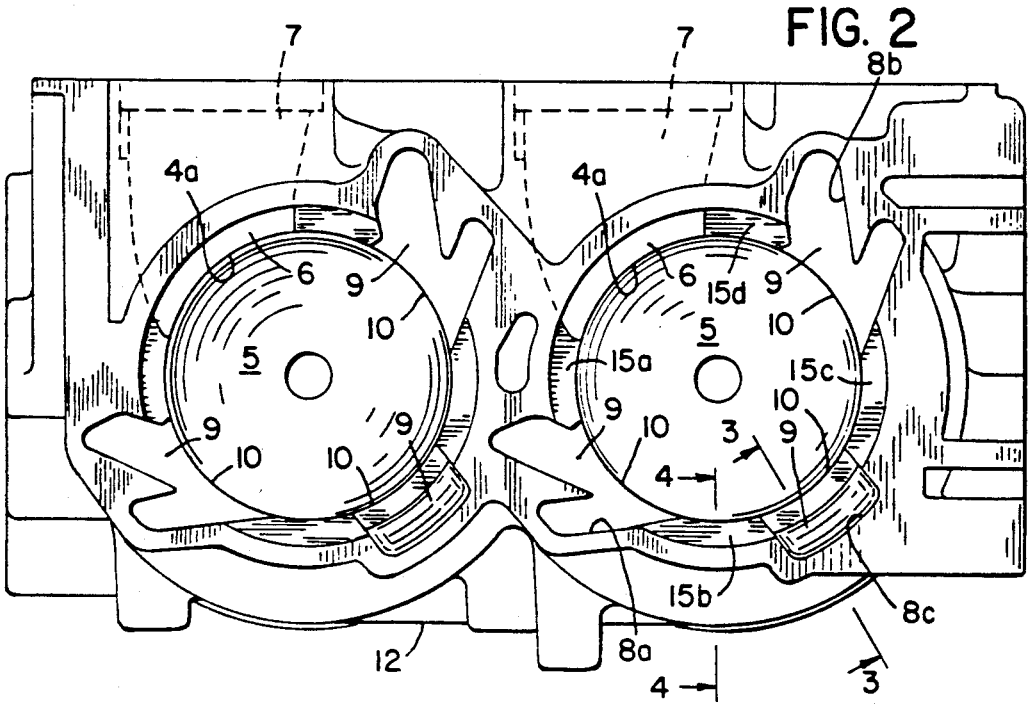
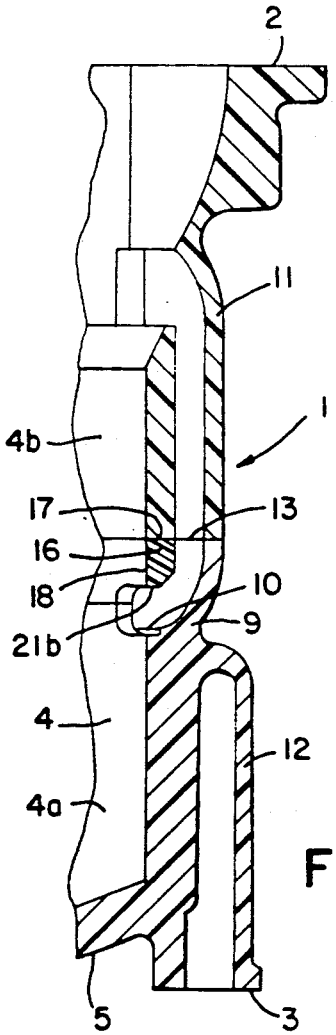
FIG. 3
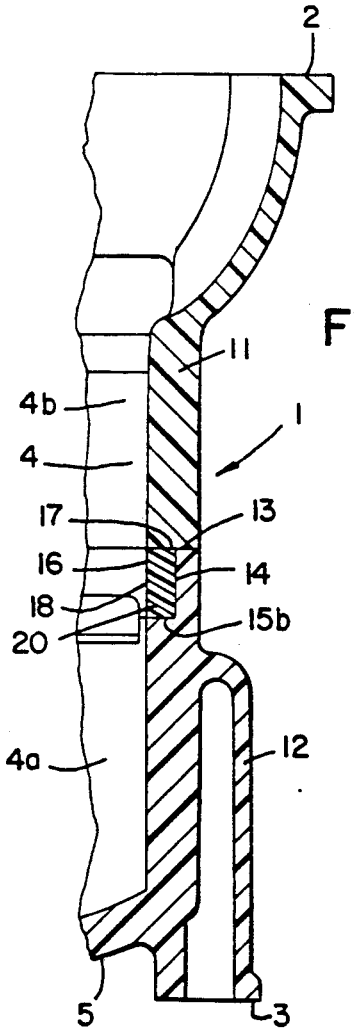
FIG. 4

EVAPORABLE FOAM PATTERN FOR CASTING A CYLINDER BLOCK OF A TWO-CYCLE ENGINE

BACKGROUND OF THE INVENTION

Cylinder blocks of two-cycle engines are normally fabricated by die casting. Recently there has been increased activity in casting the cylinder block by a lost foam process, in which the pattern is made from an evaporable polymeric material, such as polystyrene. In the typical lost foam process, the pattern is placed in a mold and an unbonded flowable material, such as sand, surrounds the pattern, as well as filling the cavities in the pattern. During casting, the heat of the molten metal will vaporize the pattern and the vapor will be entrapped within the interstices of the sand, while the metal fills the void created by evaporation of the foam material to provide a cast part identical in configuration to the pattern.

The casting of a two-cycle engine block has proven difficult due to the complexity of the porting and particularly the transfer passages. A typical two-cycle engine includes one or more transfer passages which provide communication between the crankcase and the upper ends of the cylinders. With a loop charge system, a combustible charge is drawn upwardly from the crankcase through a group of three transfer passages to the head end of the cylinder. The charges converge below the spark plug and the confluent charge is compressed by the upward stroke of the piston. After ignition by the spark, waste gases of combustion are expelled through the cylinder exhaust port with the downward power stroke of the piston. To enable the fuel-air stream to flow in the desired course to the head and then flow to the exhaust port to effect removal of the spent gases, the discharge end of the transfer passage must be positioned in precise tolerance with respect to the cylinder head.

It has been proposed to fabricate an evaporable foam pattern for a two-cycle engine block from a pair of sections, i.e. a crankcase section and a head section, which are joined along a parting line extending transversely through the axes of the cylinders. In this proposal, the end of the portion of each cylinder in the head pattern section adjacent the parting line is enlarged in diameter and the crankcase section is provided with a ring-like projection that extends longitudinally from the cylinder in the crankcase section and is received within the enlarged end portion in the head section. The ring-like extension is provided with a series of ears or lugs which engage ledges bordering the enlarged cylinder portion in the head pattern section. The undercut edges or recesses between the ears serve to define the lower edges of the transfer ports. The contiguous surfaces of the two pattern sections are joined together by an adhesive.

However, it has been found difficult to properly apply the adhesive to the contiguous surfaces due to the lack of visibility when the two sections are assembled. If the layer of adhesive is inadequate, the molten metal during casting will fill the void where adhesive is lacking, while on the other hand, if excessive adhesive is applied, the adhesive can extrude from the abutting surfaces into the transfer passages and the extruded glued joint will result in a bead of metal in the cast block, which can adversely effect the flow of the charge through the transfer passages.

SUMMARY OF THE INVENTION

The invention is directed to an evaporable foam pattern for use in casting a metal engine block of a two-cycle engine, such as an engine utilizing a cross-flow charge. The pattern, which is formed of an evaporable polymeric material, such as polystyrene, has a crankcase end and a head end, and a plurality of cylinders extend from the crankcase end toward the head end. A plurality of transfer passages are disposed longitudinally of each cylinder and the lower or inlet end of each transfer passage communicates with the crankcase end of the block, while the upper or discharge end of each transfer passage communicates through a transfer port with the cylinder.

The pattern is formed of a pair of pattern sections, a crankcase pattern section and a head pattern section, which are joined along a parting line disposed normal to the axes of the cylinders. The parting line intersects the transfer passages adjacent the discharge ends of the passages.

A portion of each cylinder in the head pattern section is enlarged in diameter adjacent the parting line, and a plurality of circumferentially spaced ledges interconnect the enlarged portions with the cylinder of the head section. The ledges are located between the transfer passages.

The evaporable foam pattern also includes a separate ring which, in the assembled pattern, is located in the enlarged cylinder portion of the head pattern section. One end of the ring is provided with a plurality of circumferentially spaced projections or ears which are engaged with the ledges on the head pattern section, while the opposite end of the ring is flush with the parting line. The recessed edges between the ears on the end of the ring bridge the transfer passages and define the lower edge of each transfer passage.

The contiguous surfaces of the three pattern sections are joined together by an adhesive of the type commonly used in evaporable foam casting procedures.

To assemble the pattern, the ring is initially glued into the enlarged cylinder portion of the head pattern section, and the head and crankcase pattern are then secured together by application of the adhesive to the abutting surfaces of the parting line.

In casting the engine block, the assembled pattern is placed in a mold and surrounded by an unbonded flowable material, such as sand, which also fills the cavities in the pattern. A molten metal, such as an aluminum alloy, is fed to the pattern via a sprue and the heat of the molten metal will vaporize the pattern, with the vapor being entrapped within the interstices of the sand, while the molten metal occupies the void created by vaporization of the foam to provide a cast engine block conforming in configuration to the pattern.

The use of the ring pattern section in conjunction with the crankcase and head sections provides a more precise assembled pattern. The ring is initially assembled and glued to the head pattern section, and the interior of the cylinders and transfer passages are visible during this gluing operation, so that any excess glue or adhesive that may be extruded from the joint can be removed prior to assembling the crankcase and head sections together.

As the curved discharge ends of the transfer passages are formed integrally with the head pattern section, the desired precise tolerance can be maintained between the transfer ports and the cylinder head to obtain optimum efficiency of combustion.

In normal practice, the internal and external surfaces of the foam pattern are coated with a ceramic wash, and the pattern of the invention is designed so that the wash will freely enter and coat both the internal and external surfaces of the pattern and will fully drain therefrom.

The use of the polymeric foam pattern also produces a smoother finish on the surfaces of the casting, as opposed to sand casting, and thereby provides a more attractive appearance for the cast part.

Other objects and advantages will appear in the course of the following description.

DESCRIPTION OF THE DRAWINGS

The drawings illustrate the best mode presently contemplated of carrying out the invention.

In the drawings:

FIG. 2 is a top plan view taken along line 2—2 of FIG. 1 of the crankcase end pattern section;

FIG. 3 is a section taken along line 3—3 of FIG. 2; and

FIG. 4 is a section taken along line 4—4 of FIG. 2.

DESCRIPTION OF THE ILLUSTRATED EMBODIMENT

Figure 1:
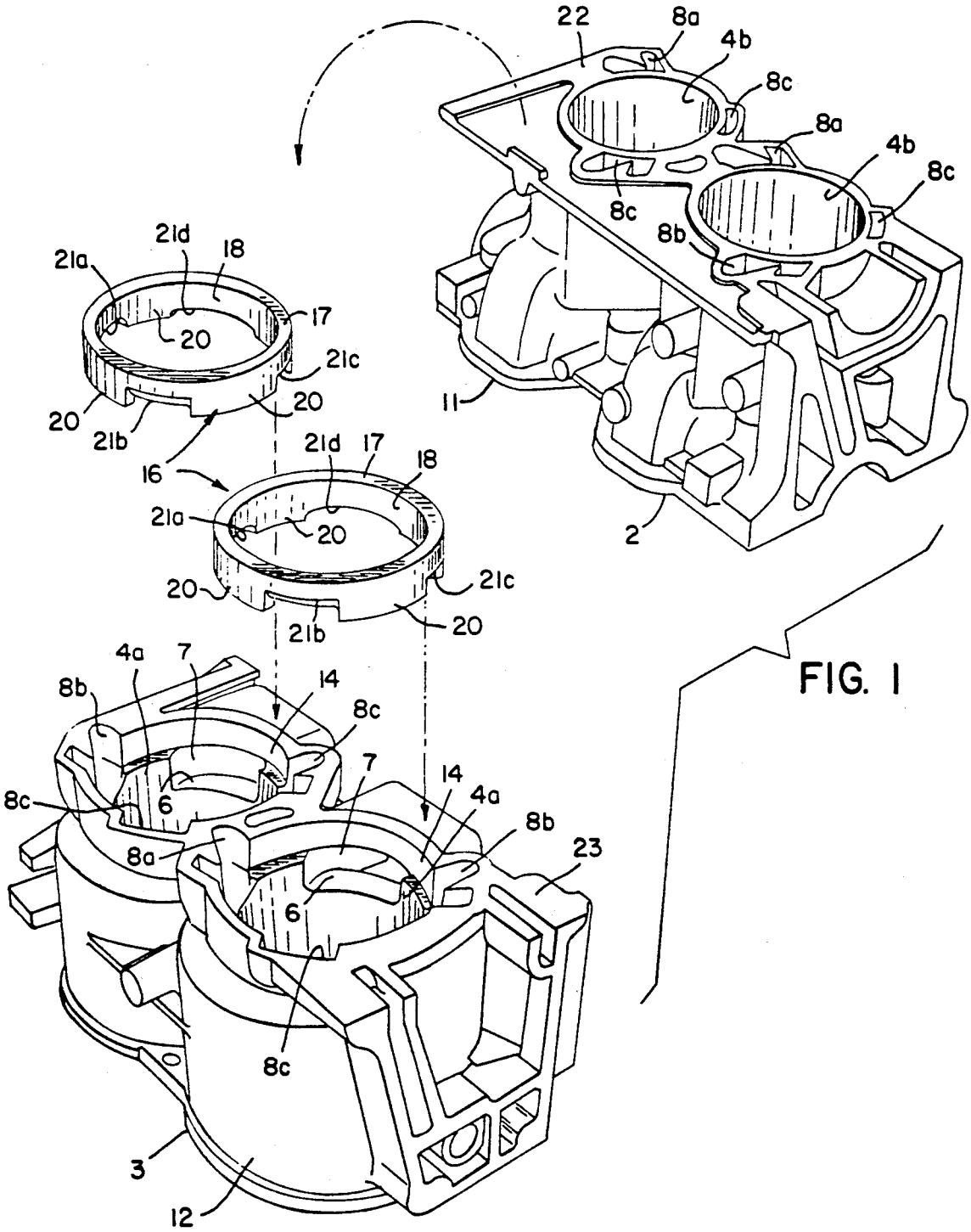
FIG. 1 is a perspective exploded view of the pattern of the invention.

The drawings illustrate an evaporable foam pattern 1 for casting a cylinder block of a two-cycle engine. The pattern is formed of an evaporable foam material, such as polystyrene or polymethylmethacrylate, and is used in a lost foam casting process. As the cast metal engine block is identical in configuration to the pattern, terminology of the components of the metal cylinder block will be used in describing the evaporable foam pattern.

Pattern 1 includes a crankcase end 2 and a head end 3. In addition, the completely assembled pattern also includes an exhaust manifold cover pattern, an exhaust manifold water jacket cover pattern, and a cylinder head water jacket pattern, all of which are not shown in the drawings, but are adapted to be attached to block pattern 1 by glue or adhesive.

Pattern 1 includes a pair of cylinders 4 and one end of each cylinder is enclosed by a dome-shaped head 5, while the opposite end of each cylinder is open to the crankcase end 2 of the pattern. An exhaust port 6 is formed in each cylinder 4 and communicates through an exhaust passage 7 to the exterior.

While the cast engine block can be positioned in various orientations, for convenience of description, the term "upper", as used in the description and claims, is intended to mean a direction toward the head end of the block, while the term "lower" is intended to mean a direction toward the crankcase end of the block.

As illustrated in FIG. 1, the cast engine block operates on a loop charge system, and thus the pattern is formed with a plurality of transfer passages **8*a*–8*c*, which extend longitudinally of each cylinder. The lower or inlet end of each transfer passage communicates with the crankcase end 2 of the pattern, while the upper or discharge end of each transfer passage is bordered by a generally curved wall 9 and communicates through a transfer port 10 with the respective cylinder adjacent the head 5** of the cylinder.

Pattern 1 is formed of a crankcase section 11 and a head pattern section 12 which are joined together along a planar parting line 13, which extends normal to the axes of cylinders 4. Parting line 13 intersects transfer passages 8 adjacent the lower end of the curved wall section 9 of each passage. Parting line 13 divides each cylinder 4 into an upper cylinder portion **4*a* which is located within head section 12 and a lower cylinder portion 4*b* which is disposed within the crankcase section 11**.

The lower end of each cylinder portion **4*a* adjacent parting line 13 is enlarged in diameter, as indicated by 14, and the enlarged portion is connected to cylinder portion 4*a* by a series of circumferentially spaced ledges or shoulders 15*a*–15*d*. Ledges 15** extend generally normal to the axis of the respective cylinder.

As best seen in FIG. 2, ledge **15*a* is located between exhaust port 6 and transfer passage 8*a*, ledge 15*b* is located between transfer passages 8*a* and 8*c*, ledge 15*c* is located between transfer passages 8*b* and 8*c* and ledge 15*d* is located between transfer passage 8*b* and exhaust port 6**.

Pattern 1 also includes a pair of separate rings 16 formed of evaporable polymeric material and which, in the assembled pattern, are disposed in the enlarged end portions 14 of the cylinders. The lower end 17 of each ring 16 is disposed at the parting line 13 and as illustrated in FIG. 3. The inner cylindrical surface 18 of ring 16 has the same diameter and forms an extension to the cylinder sections **4*a* and 4*b***.

As shown in FIG. 1, the upper end of each ring 16 is formed with a plurality of ears or projections 20 which are adapted to engage the ledges **15*a–d*. Separating each ear is a recessed edge 21*a*–21*d* and the edges 21*a–c* define the lower edges of the transfer ports 10, while the recessed edge 21*d* is located substantially flush with the lower edge of the exhaust port 6**.

The three pattern pieces or sections 11, 12, and 16 are joined together along contiguous surfaces by an adhesive of the type commonly used in lost foam casting procedures. The adhesive is the type which will vaporize when exposed to the heat of the molten metal, so that there will be no residual adhesive remaining after the casting process. More particularly the adhesive is applied to the abutting surfaces 22 and 23 of the crankcase section 11 and head section 12, respectively, as well as between ears 20 and ledges 15, and between the outer peripheral surface of ring 16 and the contiguous cylindrical wall bordering enlarged portion 14 of the head section 12.

To assemble the pattern 1, ring 16 is initially glued into the enlarged end portion 14 with ears 20 being bonded to ledges 15, and the crankcase and head sections 11 and 12 are then glued together by application of adhesive to the surfaces 17, 22 and 23 at the parting line 13.

After the pattern has been assembled, it is normally subjected to a ceramic wash which serves to coat all the internal and external surfaces of the pattern with the ceramic material. The pattern is designed so that the wash will contact all internal and external surfaces and will readily drain therefrom.

The ceramic coated pattern is then placed in a mold and surrounded by an unbonded, freely flowable material, such as sand, which also fills the cavities of the pattern. A sprue formed of evaporable polymeric material is connected to the pattern and the molten metal, such as an aluminum alloy, is fed via the sprue into contact with the pattern. The heat of the molten metal will vaporize the sprue and the pattern with the vapor being entrapped within the interstices of the sand, while the metal will occupy the void created by vaporization of the foam to provide a cast metal part identical in configuration to the pattern.

The use of the separate ring 16 enables the pattern to be more precisely assembled. The ring is initially mounted in the enlarged end portion 14 of head section 12 and secured therein by the adhesive. As the ring is open, the interior of cylinder portion 4*a* of the head section, as well as the upper ends of the transfer passages 8, are visible and if any excess adhesive should be extruded from the joints into the transfer passages it can be readily removed. This ensures that there will be no beads of metal in the transfer passages of the final cast engine block resulting from an extruded bead of glue. As the transfer passages cannot be subsequently machined, it is critical that the cast walls bordering the transfer passages be smooth and free of obstructions. Any extruded beads of metal can adversely effect the flow of the fuel-air charge through the transfer passages and thus detract from the performance of the engine.

As the discharge ends 9 of the transfer passages 8 are all located in the same pattern section 12 with the cylinder heads 5, the desired precise tolerance can be maintained between the transfer ports and the head to obtain optimum efficiency of combustion.

Various modes of carrying out the invention are contemplated as being within the scope of the following claims particularly pointing out and distinctly claiming the subject matter which is regarded as the invention.

We claim:

1. A pattern assembly for casting a metal engine block for a two-cycle engine, comprising a pattern formed of an evaporable polymeric material and having a crankcase end and a head end and having at least one cylinder extending from said crankcase end toward said head end, said pattern having at least one transfer passage disposed longitudinally of the cylinder with said transfer passage having an inlet end communicating with the crankcase end of said pattern and having a discharge end communicating through a transfer port with said cylinder adjacent said head end, said pattern including a crankcase section and a head section joined together along a parting line disposed normal to the axis of said cylinder, a first section of said cylinder being disposed in said crankcase section of said pattern and a second section of said cylinder being disposed in said head pattern section, a portion of said second cylinder section adjacent said parting line being enlarged in diameter, said head pattern section having a plurality of circumferentially spaced ledges interconnecting said second cylindrical section and said enlarged portion, said ledges bordering said transfer passage, a separate ring formed of evaporable polymeric material and disposed in said enlarged portion and having a first end disposed in engagement with said ledges, the portion of said first end of said ring disposed between said spaced ledges defining an edge of said transfer port, and-adhesive means joining the contiguous surfaces of said head section and said crankcase section and said ring.

2. The pattern assembly of claim 1, wherein the portion of said first end comprises a recessed edge.

3. The pattern assembly of claim 1, wherein said ring has a second end disposed at said parting line.

4. The assembly of claim 2, and including exhaust port means disposed in said head pattern section and communicating with said second cylinder section.

5. The assembly of claim 1, wherein said first end has a plurality of said portion each disposed between adjacent ledges, one of the plurality of said portion bordering said exhaust passage means.

6. The assembly of claim 1, wherein said adhesive means is disposed between the first end of said ring and said ledges and is disposed between the outer surface of said ring and the surface of said head pattern section bordering said enlarged portion and is disposed at said parting line.

7. An evaporable foam pattern assembly for casting a metal engine block for a two-cycle engine, comprising a pattern composed of evaporable polymeric material and having a crankcase end and a head end and having a plurality of cylinders extending from said crankcase end toward said head end, said pattern having a plurality of transfer passages disposed longitudinally of each cylinder, each transfer passage having an inlet end communicating with the crankcase end of the pattern and having a discharge end communicating through a transfer port with the respective cylinder adjacent the head end, said pattern including a crankcase pattern section and a head pattern section joined together along a parting line disposed normal to the axes of said cylinders and disposed adjacent the discharge ends of the transfer passages, the portion of each cylinder located in said head section and disposed adjacent said parting line being enlarged in diameter to provide an enlarged cylindrical portion, a plurality of circumferentially spaced ledges disposed on said head pattern section and interconnecting said enlarged cylindrical portion with said cylinder, said ledges being disposed between said transfer passages, an evaporable foam ring disposed in said enlarged cylindrical portion, a plurality of circumferentially spaced ears disposed on a first end of said ring and disposed in engagement with said ledges, said ring having a plurality of recessed edges between said ears and bridging said transfer passages and defining an edge of the respective transfer port, a second end of said ring being disposed at said parting line, and adhesive means for joining the contiguous portions of said head pattern section and said crankcase pattern section and said ring.

8. A pattern assembly for casting a metal engine block for a two-cycle engine, comprising a pattern formed of an evaporable polymeric material and having a crankcase end and a head end and having at least one cylinder extending from said crankcase end toward said head end, said pattern having at least one transfer passage disposed longitudinally of the cylinder with said transfer passage having an inlet end communicating with the crankcase end of said pattern and having a discharge end communicating through a transfer port with said cylinder adjacent said head end, said pattern including a crankcase section and a head section having abutting surfaces joined together along a parting line disposed normal to the axis of said cylinder, a first section of said cylinder being disposed in said crankcase section of said pattern and a second section of said cylinder being disposed in said head pattern section, a portion of said second cylinder section adjacent said parting line being enlarged in diameter, inwardly extending ledge means bordering said transfer passage and interconnecting said enlarged cylinder portion with said second cylinder section, a ring disposed in said enlarged cylinder portion and having a inner annular surface forming an extension to said second cylinder section, a first end of said ring disposed in engagement with said ledge means and a second end of said ring being disposed at said parting line, portions of said ring located circumferentially between said ledge means defining an edge of the respective transfer ports, first securing means for securing said ring in said enlarged cylinder portion, and second securing means for securing said abutting surfaces together.

9. An evaporable foam pattern for casting a two-cycle engine block, comprising a crankcase pattern section having a lower crankcase end and an upper end and having a lower cylinder section extending between said ends, said crankcase pattern section having at least one transfer passage disposed longitudinally of the axis of said cylinder section and having a first end communicating with said crankcase end and a second end communicating with the upper end of said crankcase pattern section, a head pattern section having a lower end disposed in abutting relation with the upper end of said crankcase pattern section and having an upper end, said head pattern section having an upper cylinder section axially aligned with the lower cylinder section of said crankcase section, a portion of the upper cylinder section disposed at said lower end having an enlarged diameter, said head pattern section having a plurality of transfer passages, one end of each transfer passage in said head pattern section communicating with said lower end and mating with a transfer passage in said crankcase pattern section, the opposite end of each transfer passage in said head pattern section communicating with the respective upper cylinder section through a transfer port, a plurality of circumferentially spaced ledges interconnecting the enlarged diameter portion and said upper cylinder section, said ledges disposed between the transfer passages in said head pattern section, a ring formed of evaporable polymeric material disposed in said enlarged portion and having an -inner diameter conforming to the diameters of said upper and lower cylinder sections, said ring having a first end disposed in engagement with said ledges and having a second end disposed flush with said abutting ends of pattern sections, portions of the first end of said ring located between said adjacent ledges defining edges of the respective transfer ports, and adhesive means joining said abutting ends and joining said first end of said ring and said ledges.

10. The pattern assembly of claim 9, wherein the first end of said ring has a plurality of circumferentially spaced longitudinally extending ears disposed in engagement with said ledges, said portions of the first end of the ring comprising recessed edges disposed between said ears.

11. A method of producing an evaporable foam pattern for use in casting a metal engine block for a two cycle engine, comprising the steps of forming an evaporable polymeric foam crankcase pattern section having a lower crankcase end and an upper end and having a lower cylinder section and a lower transfer passage section extending between said ends, forming an evaporable polymeric foam head pattern section having a lower end and an upper end and having an upper cylinder section and an upper transfer passage section extending from said lower end and communicating with said upper cylinder section, forming a portion of the upper cylinder section adjacent said lower end with an enlarged diameter with a ledge interconnecting said enlarged portion with said upper cylinder section, forming a ring of evaporable polymeric foam material having an internal diameter substantially equal to the diameter of said cylinder sections, inserting the ring in said enlarged diameter portion and positioning an upper end of the ring against said ledge, securing the contiguous surfaces of said ring and said head pattern section together, disposing the upper end of the crankcase pattern section and the lower end of the head pattern section in abutting relation with said cylindrical sections and said transfer passage sections being in mating relation, and securing said abutting ends together.

12. The method of claim 11, wherein the step of securing said contiguous surfaces comprises applying an adhesive to said contiguous surfaces,.and the step of securing said abutting ends comprises applying an adhesive to said abutting ends.

13. The method of claim 11, and including the step of positioning a second end of said ring in substantially flush relation with the lower end of the head pattern section.

14. The method of claim 11, and including the step of forming a plurality of circumferentially spaced ledges between said enlarged portion and said upper cylinder section with said ledges bordering said upper transfer passage section, forming the first end of the ring with a plurality of circumferentially spaced ears with recessed edges between said ears, and positioning said ears in engagement with said ledges.

* * * * *